US006379286B1

(12) United States Patent
Scopino et al.

(10) Patent No.: US 6,379,286 B1
(45) Date of Patent: Apr. 30, 2002

(54) EXERCISE BATON WITH REMOVABLE INTERNAL WEIGHTS

(76) Inventors: David S. Scopino, 30 Harrison Dr., Wolcott, CT (US) 06716; Jack R. Lander, 37 Seneca Rd., Danbury, CT (US) 06811

( * ) Notice: Subject to any disclaimer, the term of this patent is extended or adjusted under 35 U.S.C. 154(b) by 2 days.

(21) Appl. No.: 09/756,022

(22) Filed: Jan. 8, 2001

(51) Int. Cl.[7] ..... A63B 15/02; A63B 21/075

(52) U.S. Cl. ..... 482/93; 482/106; 482/109

(58) Field of Search ..... 482/1, 50, 74, 482/91–94, 106–109; 446/219; 135/65, 910; 473/516; 463/47.2

(56) References Cited

U.S. PATENT DOCUMENTS 688,599 A * 12/1901 Creelman
744,348 A * 11/1903 Hurst
3,758,109 A * 9/1973 Bender ..... 482/93
4,021,040 A 5/1977 Inoue
4,099,535 A * 7/1978 Hubachek ..... 135/66
4,157,827 A 6/1979 Winston et al.
4,345,757 A 8/1982 Lo Voi
4,361,324 A 11/1982 Baroi
4,600,974 A * 7/1986 Lew et al. ..... 362/102
4,610,447 A 9/1986 Byrd
4,618,142 A 10/1986 Joseph, Jr.
4,625,742 A * 12/1986 Phillips ..... 135/66
5,022,648 A 6/1991 Travis
5,219,402 A * 6/1993 Kondo et al. ..... 135/66
5,316,531 A 5/1994 Spence
5,328,431 A 7/1994 Winslow
5,403,256 A * 4/1995 Squires ..... 482/91
5,407,413 A 4/1995 Kupferman
5,428,514 A 6/1995 Fink, Jr.
5,536,227 A 7/1996 Polchek et al.
5,653,664 A * 8/1997 Jennings ..... 482/93
5,876,312 A 3/1999 McClendon

* cited by examiner

*Primary Examiner*—Jeanette Chapman
*Assistant Examiner*—Victor K. Hwang
(74) *Attorney, Agent, or Firm*—Robert J. Harter

(57) ABSTRACT

An exercise baton includes a tube having within its interior several elongated s weights. The weights can be added and removed without changing the external shape of the baton. A divider inside the tube helps keep the weights properly distributed, so that the baton is kept centrally balanced regardless of the number of weights. The divider plus a resiliently compressible pad help keep the weights from rattling. The tube is made of clear plastic, so one can see how many weights are inside. In some embodiments, a photoluminescent material, or some other light source, is placed inside the baton so light can shine out through the tube.

4 Claims, 1 Drawing Sheet

EXERCISE BATON WITH REMOVABLE INTERNAL WEIGHTS

BACKGROUND OF THE INVENTION

1. Field of the Invention

The subject invention generally pertains to exercise equipment and more specifically to a lifting bar with adjustable weight.

2. Description of Related Art

Dumbbells and weights attached to bars have been around for many years. Such exercise bars come in a wide variety of styles to serve various functions. For simply building strength, a suitable bar may have externally mounted weights. External weights, however, can interfere with certain exercises meant for rehabilitation or for improving flexibility. Thus, a physical therapist or other professional trainers may have their clients use a simple rod, such as a broomstick, to perform exercises such as those used to improve range-of-motion.

Unfortunately, a broomstick or other wooden rod is often too light for many users. A heavier rod, such as a steel bar, can be used, but some may find it too heavy. Moreover, the weight requirement of any particular user may change, and a rod of a fixed weight may not meet that change. In some cases, reducing weight to accommodate conditions such as pain, tightness, spasms, injury, etc. may be as important to a user as the progressive addition of weight as the user improves.

Some exercise devices have provisions for adding or removing internal weights, such as those disclosed in U.S. Pat. Nos. 4,157,827 and 5,876,312. In both devices, however, the internal weights appear able to shift when less than the maximum number of weights is installed. For the '827 device, it appears that a single internal weight could move sideways without first deforming the device's exterior. But deforming the exterior shifts the device's center of gravity off center. In the '312 device, the center of gravity appears able to shift axially when fewer than four balls are installed in any one chamber. Regardless of which direction the internal weights shift, the feel and sound of shifting weights may be an annoying distraction to many users.

SUMMARY OF THE INVENTION

To overcome the limitations of existing exercise bars, it is an object of the invention to provide a baton where incremental weights can be added or removed without significantly altering the baton's external shape.

A second object of the invention it to provide a baton than can separate into two pieces for easy transport and storage.

A third object is to provide baton with calibrated weights so that numeric weight used at specific dates can be recorded for scientific assessment of the user's progress. Such objective record can be especially useful for insurance claim purposes, as in cases of the baton's use in physical therapy. Further, by having measurable increments, the user has an incentive for progress.

A forth object is to provide an internal source of light for use in exercising, thereby providing visual entertainment, as in a group being drilled or as an added attraction for children, mentally impaired, and others.

A fifth object is to provide an internal source of light to distract the user, thereby reducing the boredom that often accompanies exercise routines, and thus helping the user to exercise longer.

A sixth object of the invention is to produce the baton of a clear plastic housing for the ease of viewing the weights and to enable light to shine out from inside the baton.

A seventh object is to evenly distribute the internal weights of a baton around its internal circumference with sufficient space for light to shine between adjacent weights.

An eighth object is to provide highly reflective weights to enhance the reflection of light.

A ninth object is to help keep a baton's internal weights from rattling or shifting.

A tenth object is to provide a weight divider that evenly distributes several weights within a baton so as to place the weights' cumulative center of gravity on a longitudinal centerline of a baton, regardless of the number of weights.

An eleventh object is to provide an exercise baton with internal weights that, if desired, can be offset to either end of the baton without affecting the exterior shape of the baton. In some cases, offset weights can be a benefit where there is a need for exercising one arm more than another.

These and other objects of the invention may be provided by a baton that includes a tube having within its interior several elongated weights. A divider inside the tube helps keep the weights properly distributed. Although a single embodiment may not necessarily achieve all of the above-listed objects of the invention, various forms of the invention may achieve various individual objects.

DESCRIPTION OF THE PREFERRED EMBODIMENT

Figure 1:
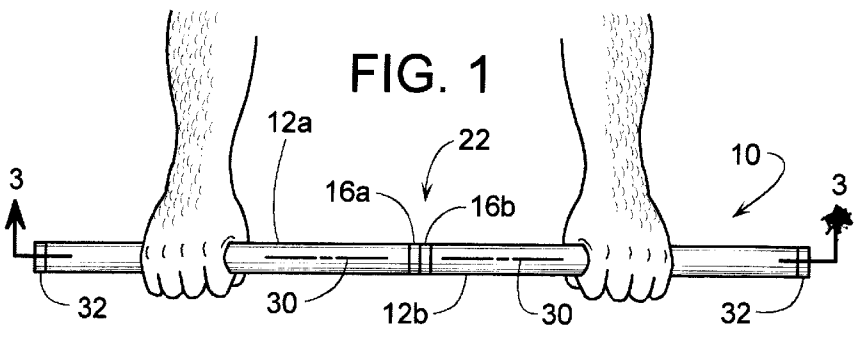
FIG. 1 is a front view of an exercise baton in use according to one embodiment of the invention.
Figure 3:
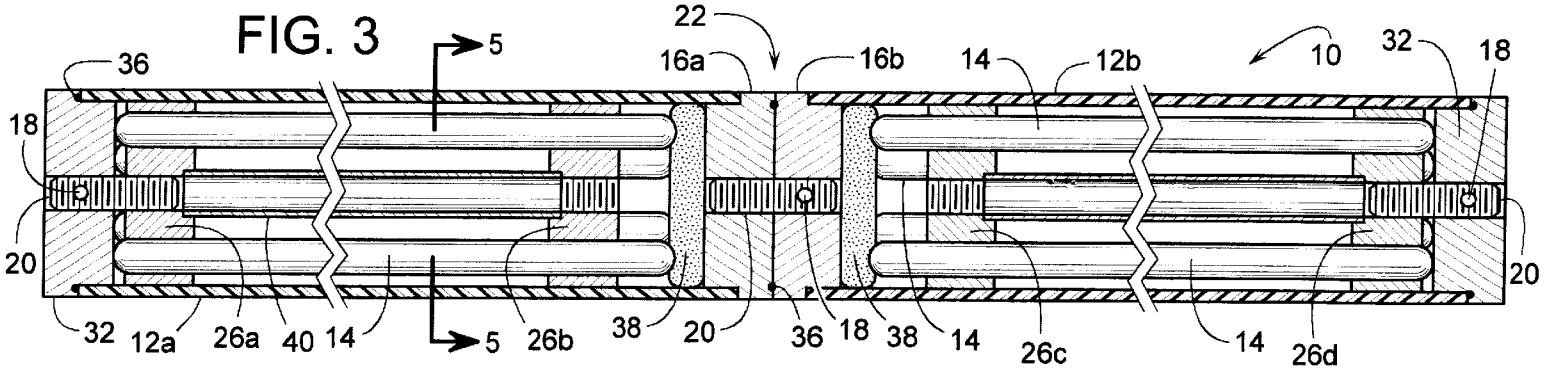
FIG. 3 is a cross-sectional view taken along line 3—3 of FIG. 1.
Figure 2:
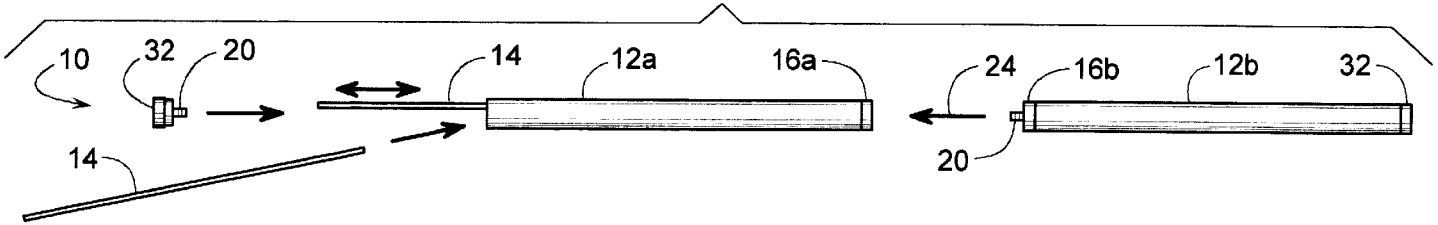
FIG. 2 is an partially exploded view of the baton of FIG. 1 showing the baton separated and how internal weights can be changed.

An exercise baton 10, shown in FIGS. 1–3, includes two generally rigid tubes 12*a* and 12*b* each having an interior adapted to contain several elongated weights 14, such as ¼ inch diameter steel rods. However, more or less than two tubes are well within the scope of the invention.

Each tube 12*a* and 12*b* includes a fixed end cap 16*a* and 16*b* respectively. Caps 16*a* and 16*b* can be fixed to their respective tube by a variety of ways including, but not limited to, adhesive, press-fit, conventional fastener, etc. Both caps have a centrally located threaded hole. A pin 18 fixes one end of a threaded fastener 20 to cap 16*b* while an opposite end screws into the threaded hole of cap 16*a*. Thus, caps 16*a* and 16*b*, pin 18, and threaded fastener 20 provide a connection 22 that releasably connects tubes 12*a* and 12*b*, with the assembly process being depicted by arrow 24 of FIG. 2.

Figure 5:
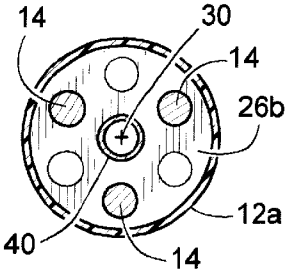
FIG. 5 is a cross-sectional view taken along line 5—5 of FIG. 3, but with only three weights installed.
Figure 4:
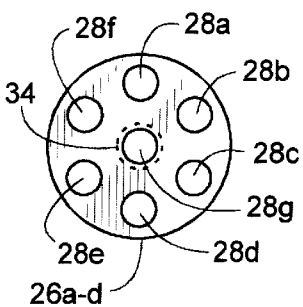
FIG. 4 is an end view of a divider used in the baton of FIG. 1.

Referring further to FIGS. 4 and 5, two dividers 26*a* and 26*b* are held fixed within tube 12*a* and another two dividers 26*c* and 26*d* are similarly held within tube 12*b*. As with the tubes, the use ofjust one divider is well within the scope of the invention. However, two axially spaced dividers in each tube work well in supporting opposite ends of weight 14. The dividers can be held fixed within their respective tube by any of a variety of ways including, but not limited to adhesive, press-fit, conventional fastener, etc. Each divider includes several chambers 28*a–f*, each of which are adapted to receive a weight 14. The dividers also include a central chamber 28*g* that can hold a weight slightly shorter than weight 14 or can be left open.

Chambers 28*a–g* are positioned to evenly space and distribute weights 14 within tubes 12*a* and 12*b*. In particular, the chambers can keep several weights' individual center of gravity (i.e., the center of gravity of one weight) radially offset relative to a longitudinal centerline 30 of tubes 12*a* and 12*b*, yet the collective center of gravity (i.e., the center of gravity of a group of weights) can still be maintained substantially on centerline 30. This provides a comfortably balanced baton regardless of the number of weights 14, including cases where no weights 14 are installed. For one weight, the weight is place in chamber 28*g*; for two weights, chambers 28*a* and 28*b* are used; three weights use chambers 28*b*, 28*d* and 28*f* (see FIG. 5); four weights use chambers 28*b*, 28*c*, 28*e*and 28*f*, five weights use chambers 28*a*, 28*b*, 28*d*, 28*e* and 28*g*; six weights use 28*a–f*, and seven weights use 28*a–g*.

A threaded cap 32 at one end of each of tubes 12*a* and 12*b* allow weights 14 to be added and removed. The process of adding and removing weights is shown FIG. 2 with reference to tube 12*a*; however, the process is the same for tube 12*b*, but with the weights being added or removed from the opposite end of baton 10. Pin 18 fixes threaded fastener 20 to cap 32. Fastener 20, in turn, screws into a threaded bore 34 of divider 26*a* or 26*b* to hold cap 32 snugly against tube 12*a* or 12*b*. An O-ring 36 can be used to provide some friction and axial resilience that helps keep cap 32 from accidentally unscrewing. O-ring 36 can also be used on connection 22 to serve a similar function.

Upon screwing caps 32 in place, an inside axial face of cap 32 pushes each weight 14 against an opposite facing, resiliently compressible pad 38. This help keep weights 14 from rattling back and forth axially (i.e., in a direction parallel to centerline 30 and perpendicular to a radial direction). In some cases, it may be desirable to install more weights in tube 12*a* than tube 12*b* to exercise a person's one arm than another.

In some embodiments of the invention, a light source 40 is installed inside tubes 12*a* and 12*b*, and the tubes are made of a plastic material that can transmit light (e.g., transparent or translucent polycarbonate, acrylic, polystyrene, polypropylene, polyethylene, etc). Tubes 12*a* and 12*b* are preferably transparent, so one can readily see how many weights 14 are inside. Light source 40 is schematically illustrated to encompass any light emitting object including, but not limited to, a strontium coated tube, a photoluminescent rod, incandescent light, fluorescent light, tube light, light emitting diode, etc. When baton 10 includes light source 40, weights 14 are preferably polished to a highly reflective finish and sufficiently spaced apart to allow light to pass between adjacent weights 14.

Although the invention is described with reference to a preferred embodiment, it should be appreciated by those skilled in the art that various modifications are well within the scope of the invention. Therefore, the scope of the invention is to be determined by reference to the claims that follow.

We claim:

1. An exercise baton, comprising:

a tube defining an interior and a longitudinal centerline;

a plurality of elongated weights for disposition within the interior such that the number of elongated weights can be selectively increased and decreased while maintaining an exterior shape of the exercise baton substantially constant; and a divider disposed within the interior and defining a plurality of chambers that distribute the plurality of elongated weights such that an individual center of gravity of each of the plurality of weights is radially offset relative to the longitudinal centerline of the tube and a collective center of gravity of the plurality of weights lies substantially along the longitudinal centerline wherein the divider further defines a central chamber disposed along the longitudinal centerline and being adapted to fully receive one of the plurality of elongated weights.

2. The exercise baton of claim 1, wherein the number of elongated weights can be selectively increased and decreased by one and still maintain the collective center of gravity substantially at the longitudinal centerline.

3. The exercise baton of claim 1, wherein the divider keeps the plurality of elongated weights separated from each other.

4. An exercise baton, comprising:

a tube defining an interior and a longitudinal centerline and being able to pass light laterally therethrough;

a plurality of elongated weights disposed within the interior such that the number of elongated weights can be selectively increased and decreased while maintaining an exterior shape of the exercise baton substantially constant;

a divider disposed within the interior and defining a plurality of chambers that distribute the plurality of elongated weights such that an individual center of gravity of each of the plurality of weights is radially offset relative to the longitudinal centerline of the tube and a collective center of gravity of the plurality of weights lies substantially along the longitudinal centerline regardless of whether the number of weights is changed by one;

a light source element disposed within the tube and projecting light laterally between plurality of weights and laterally through the tube; and a threaded connection at one end of the tube that facilitates connecting the exercise baton to an additional weight.

* * * * *